US008354791B2

(12) United States Patent
Shimoi et al.

(10) Patent No.: US 8,354,791 B2
(45) Date of Patent: Jan. 15, 2013

(54) PHOTOMULTIPLIER TUBE

(75) Inventors: Hideki Shimoi, Hamamatsu (JP); Hiroyuki Kyushima, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 32 days.

(21) Appl. No.: 12/904,641

(22) Filed: Oct. 14, 2010

(65) Prior Publication Data

US 2012/0091889 A1 Apr. 19, 2012

(51) Int. Cl.
*H01J 43/18* (2006.01)

(52) U.S. Cl. ..... 313/533; 313/532; 313/535; 313/336; 313/542; 313/544; 313/103 R; 313/103 CM; 313/104; 313/105 R

(58) Field of Classification Search ..... 313/532–536, 313/103 R, 104, 105 R, 308
See application file for complete search history.

(56) References Cited

U.S. PATENT DOCUMENTS

| | | | | |
|---|---|---|---|---|
| 5,264,693 | A | 11/1993 | Shimabukuro et al. | |
| 5,568,013 | A | 10/1996 | Then et al. | |
| 5,744,908 | A | 4/1998 | Kyushima | |
| 7,049,747 | B1 | 5/2006 | Goodberlet et al. | |
| 7,294,954 | B2 | 11/2007 | Syms | |
| 2006/0220554 | A1 | 10/2006 | Ohmura et al. | |
| 2009/0218944 | A1 * | 9/2009 | Kyushima et al. | 313/532 |
| 2009/0224666 | A1 * | 9/2009 | Kyushima et al. | 313/533 |
| 2009/0283290 | A1 | 11/2009 | Shimoi et al. | |
| 2010/0213837 | A1 | 8/2010 | Shimoi et al. | |
| 2010/0213838 | A1 | 8/2010 | Sugiyama et al. | |

FOREIGN PATENT DOCUMENTS

| | | |
|---|---|---|
| EP | 0 690 478 | 1/1996 |
| JP | 8-17389 | 1/1996 |

OTHER PUBLICATIONS

"Succeeded in developing the advanced photomultiplier using the world's first MEMS technology for manufacturing semiconductors in an effort to address miniaturization trend and mass production", Sep. 28, 2010, Hamamatsu Photonics K.K. News Release, pp. 1-5 [includes English translation].
"μ PMT-Future PMT from Hamamatsu—", Hamamatsu Photonics K.K., Technical Information, Feb. 2010.

* cited by examiner

*Primary Examiner* — Nimeshkumar Patel
*Assistant Examiner* — Thomas A Hollweg
(74) *Attorney, Agent, or Firm* — Drinker Biddle & Reath LLP

(57) ABSTRACT

The photomultiplier tube 1 is provided with an upper frame 2 and a lower frame 4 which are arranged so as to oppose each other, with the respective opposing surfaces 20*a*, 40*a* made with an insulating material, a side wall part 3 which constitutes a casing together with the frames 2, 4, a plurality of stages of electron multiplying parts 33 which are arrayed so as to be spaced away sequentially from a first end side to a second end side on the opposing surface 40*a* of the lower frame 4, a photocathode 41 which is installed on the first end side so as to be spaced away from the electron multiplying parts 33, converting incident light from outside to photoelectrons, an anode part 34 which is installed on the second end side so as to be spaced away from the electron multiplying parts 33 to take out electrons multiplied by the electron multiplying parts 33 as a signal, and a wall-like electrode 32 which is arranged so as to enclose the photocathode 41 when viewed from a direction directly opposite to an opposing surface 401 and having a notched part 35 at a site opposing the electron multiplying parts 33 on the second end side.

11 Claims, 10 Drawing Sheets

PHOTOMULTIPLIER TUBE

BACKGROUND OF THE INVENTION

1. Field of the Invention

The present invention relates to a photomultiplier tube for detecting incident light from outside.

2. Related Background Art

Conventionally, compact photomultiplier tubes by utilization of fine processing technology have been developed. For example, there is known a thin-type photomultiplier tube where a photocathode, dynodes, an anode, etc., are arranged on a substrate constituting a casing (refer to Patent Document 1 given below). The above-described structure makes it possible to realize fine processing of a device in a two-stage manufacturing process.

Patent Document 1: U.S. Pat. No. 5,568,013

SUMMARY OF THE INVENTION

However, in the above-described conventional photomultiplier tube, there is a case where some of the photoelectrons emitted from the photocathode are not made incident onto electron multiplying parts but onto a side pipe, a substrate, etc., constituting the casing depending on a potential of the casing. Therefore, the photoelectrons are made incident away from the electron multiplying part, which is then the cause for a decrease in detection sensitivity.

Under these circumstances, the present invention has been made in view of the above problem, an object of which is to provide a photomultiplier tube capable of enhancing the detection sensitivity by causing photoelectrons emitted from a photocathode to be made efficiently incident onto electron multiplying parts.

In order to solve the above problem, the photomultiplier tube of the present invention is provided with a first substrate and a second substrate which are arranged so as to oppose each other, with the respective opposing surfaces made with an insulating material, a side wall part which constitutes a casing together with the first and the second substrates, a plurality of stages of electron multiplying parts which are arrayed so as to be spaced away sequentially from a first end side to a second end side on the opposing surface of the first substrate, a photocathode which is installed on the first end side so as to be spaced away from the electron multiplying parts, converting incident light from outside to photoelectrons to emit the photoelectrons, an anode part which is installed on the second end side so as to be spaced away from the electron multiplying parts to take out electrons multiplied by the electron multiplying parts as a signal, and a wall-like electrode which is arranged so as to enclose the photocathode when viewed from a direction directly opposite to the opposing surface and having a notched part at a site opposing the electron multiplying parts on the second end side.

According to the above-described photomultiplier tube, incident light is made incident onto the photocathode, by which the light is converted to photoelectrons, these photoelectrons are made incident onto a plurality of stages of electron multiplying parts on the opposing surface of the first substrate and multiplied accordingly, and thus multiplied electrons are taken out from the anode part as an electric signal. Here, the photocathode is enclosed with the wall-like electrode when viewed from a direction directly opposite to the opposing surface of the substrate, and the notched part is formed on the second end side of the wall-like electrode. Therefore, photoelectrons from the photocathode are efficiently guided into the electron multiplying parts and, as a result, it is possible to enhance the detection sensitivity of incident light onto the photocathode.

It is preferable that the photocathode is electrically connected to the wall-like electrode. In this instance, since there is formed an electric field preferable in guiding photoelectrons from the photocathode into the electron multiplying parts, the photoelectrons can be efficiently guided into the electron multiplying parts to further enhance the detection sensitivity of incident light.

It is also preferable that the notched part is formed at a site corresponding to a region of electron multiplying channels of the electron multiplying parts. The above constitution makes it possible to guide more efficiently the photoelectrons into an electron multiplying region at the electron multiplying parts and further enhance the detection sensitivity of incident light.

Further, it is preferable that focusing electrodes for focusing photoelectrons emitted from the photocathode and guiding them into the electron multiplying parts are installed inside the notched part. In this instance, the photoelectrons can be guided more efficiently into the electron multiplying parts to further enhance the detection sensitivity of incident light.

It is also preferable that the wall-like electrode is provided with a connecting part for electrically connecting to the photocathode. Further, it is also preferable that there are provided conductive layers installed on the upper surface of the connecting part and at a part of the opposing surface, the connecting part is formed in a flat-plate shape which is thinner than a plate-like part enclosing the photocathode of the wall-like electrode, and the photocathode is installed on the opposing surface and on the conductive layers. In this instance, the wall-like electrode can be reliably electrically connected to the photocathode.

Still further, it is preferable that the conductive layer installed on the upper surface of the connecting part is electrically connected to the conductive layer installed at a part of the opposing surface by using a wire member made with a conductive material. In this instance, even where there is a bump between the connecting part and the photocathode, the wall-like electrode can be reliably electrically connected to the photocathode.

DESCRIPTION OF THE PREFERRED EMBODIMENTS

Figure 1:
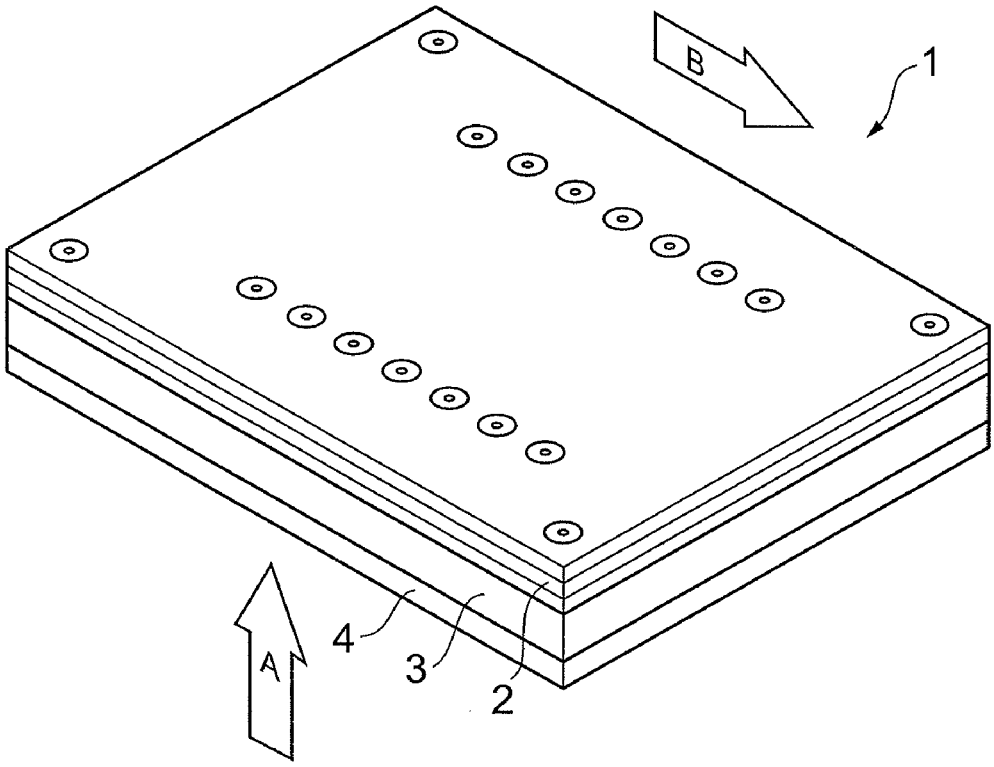
FIG. 1 is a perspective view of a photomultiplier tube which is related to one preferred embodiment of the present invention.

Hereinafter, a detailed description will be given for preferred embodiments of the photomultiplier tube related to the present invention by referring to drawings. In addition, in describing the drawings, the same or corresponding parts will be given the same reference numerals to omit overlapping description.

Figure 2:
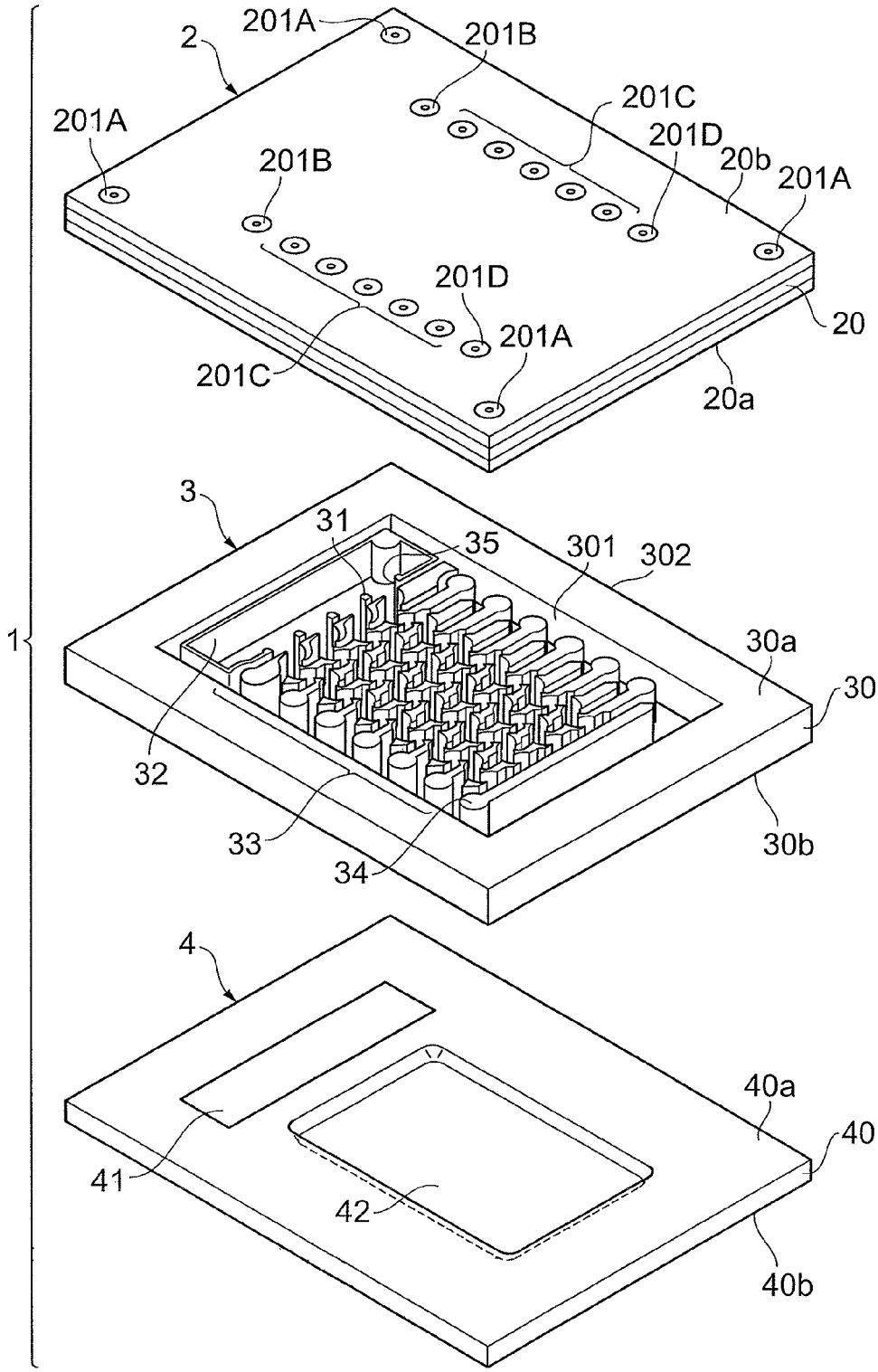
FIG. 2 is an exploded perspective view of the photomultiplier tube shown in FIG. 1.
Figure 3:
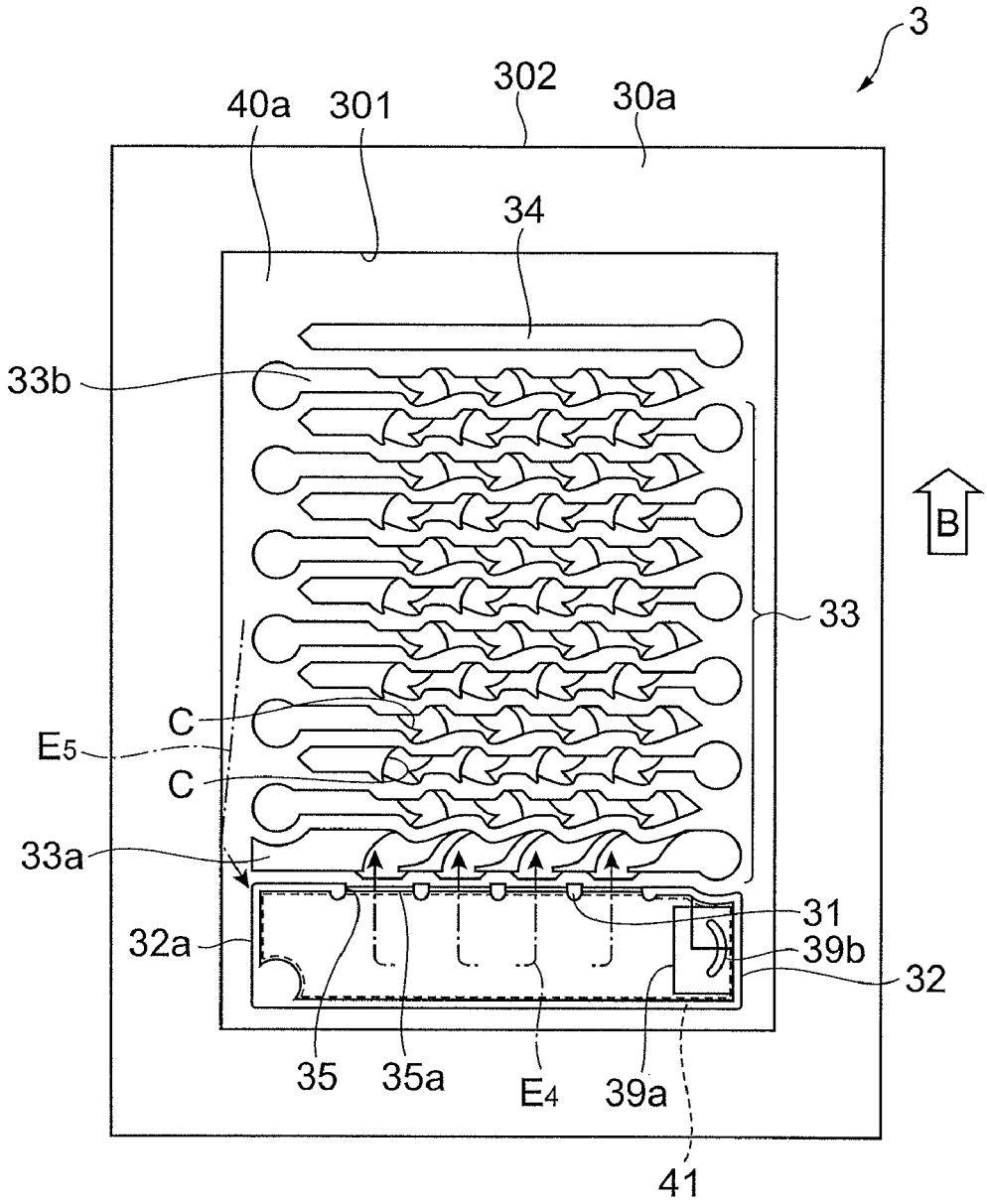
FIG. 3 is a plan view which shows a side wall frame of FIG. 1.

FIG. 1 is a perspective view of a photomultiplier tube 1 related to one preferred embodiment of the present invention. FIG. 2 is an exploded perspective view of the photomultiplier tube 1 shown in FIG. 1. FIG. 3 is a plan view of the side wall frame 3 of FIG. 1.

The photomultiplier tube 1 shown in FIG. 1 is a photomultiplier tube having a transmission-type photocathode and provided with a casing constituted with an upper frame (a second substrate) 2, a side wall frame (a side wall part) 3, and a lower frame (a first substrate) 4 which opposes the upper frame 2, with the side wall frame 3 kept therebetween. The photomultiplier tube 1 is an electron tube such that when light is made incident from a direction at which a light incident direction onto the photocathode intersects with a direction at which electrons are multiplied at electron multiplying parts, that is, a direction indicated by the arrow A in FIG. 1, photoelectrons emitted from the photocathode are made incident onto the electron multiplying parts, thereby secondary electrons are subjected to cascade amplification in a direction indicated by the arrow B to take out a signal from the anode part.

It is noted that in the following description, the upstream side of an electron multiplying channel (the side of the photocathode) along a direction at which electrons are multiplied is given as "a first end side," while the downstream side (the side of the anode part) is given as "a second end side." Further, a detailed description will be given for individual constituents of the photomultiplier tube 1.

As shown in FIG. 2, the upper frame 2 is constituted with a wiring substrate 20 made mainly with rectangular flat-plate like insulating ceramics as a base material. As the above-described wiring substrate, there is used a multilayer wiring substrate such as LTCC (low temperature co-fired ceramics) in which microscopic wiring can be designed and also wiring patterns on front-back both sides can be freely designed. The wiring substrate 20 is provided on a main surface 20*b* thereof with a plurality of conductive terminals 201A to 201D electrically connected to the side wall frame 3, a photocathode 41, focusing electrodes 31, a wall-like electrode 32, electron multiplying parts 33, and the anode part 34 which are described later, to supply power from outside and take out a signal. The conductive terminal 201A is installed for supplying power to the side wall frame 3, the conductive terminal 201B for supplying power to the photocathode 41, the focusing electrodes 31 and the wall-like electrode 32, the conductive terminal 201C for supplying power to the electron multiplying parts 33, and the conductive terminal 201D for supplying power to the anode part 34 and taking out a signal respectively. These conductive terminals 201A to 201D are mutually connected to conductive layers and the conductive terminals (details will be described later) on an insulating opposing surface 20*a* which opposes the main surface 20*b* inside the wiring substrate 20, by which these conductive layers and the conductive terminals are connected to the side wall frame 3, the photocathode 41, the focusing electrodes 31, the wall-like electrode 32, the electron multiplying parts 33 and the anode part 34. Further, the upper frame 2 is not limited to a multilayer wiring substrate having the conductive terminals 201 but may include a plate-like member made with an insulating material such as a glass substrate on which conductive terminals for supplying power from outside and taking out a signal are installed so as to penetrate.

The side wall frame 3 is constituted with a rectangular flat-plate like silicon substrate 30 as a base material. A penetration part 301 enclosed by a frame-like side wall part 302 is formed from a main surface 30*a* of the silicon substrate 30 toward an opposing surface 30*b* thereto. The penetration part 301 is provided with a rectangular opening and an outer periphery of which is formed so as to run along the outer periphery of the silicon substrate 30.

Inside the penetration part 301, the wall-like electrode 32, the focusing electrodes 31, the electron multiplying parts 33 and the anode part 34 are arranged from the first end side to the second end side. The wall-like electrode 32, the focusing electrodes 31, the electron multiplying parts 33 and the anode part 34 are formed by processing the silicon substrate 30 according to RIE (Reactive Ion Etching) processing, etc., and mainly made with silicon.

The wall-like electrode 32 is a frame-like electrode which is formed so as to enclose a photocathode 41 to be described later when viewed from a direction completely opposite to an opposing surface 40*a* of the glass substrate 40 to be described later (a direction approximately perpendicular to the opposing surface 40*a* and a direction opposite to a direction indicated by the arrow A of FIG. 1). Further, the focusing electrode 31 is an electrode for focusing photoelectrons emitted from the photocathode 41 and guiding them to the electron multiplying parts 33 and installed between the photocathode 41 and the electron multiplying parts 33.

The electron multiplying parts 33 are constituted with N stages (N denotes an integer of two or more) of dynodes (electron multiplying parts) set different in potential along a direction at which electrons are multiplied from the photocathode 41 to the anode part 34 and provided with a plurality of electron multiplying channels (electron multiplying channels) so as to be astride individual stages. Further, the anode part 34 is arranged at a position holding the electron multiplying parts 33 together with the photocathode 41.

The wall-like electrode 32, the focusing electrodes 31, the electron multiplying parts 33 and the anode part 34 are individually fixed to the lower frame 4 by anode bonding, diffusion joining and joining, etc., using a sealing material such as a low-melting-point metal (for example, indium), by which they are arranged on the lower frame 4 two-dimensionally.

The lower frame 4 is constituted with the rectangular flat-plate like glass substrate 40 as a base material. The glass substrate 40 forms an opposing surface 40*a* which opposes the opposing surface 20*a* of the wiring substrate 20, by use of glass which is an insulating material. The photocathode 41 which is a transmission-type photocathode is formed at a site opposing a penetration part 301 of the side wall frame 3 on the opposing surface 40*a* (a site other than a joining region with a side wall part 302) and at the end part opposite to the side of the anode part 34. Further, a rectangular recessed part 42 which prevents multiplied electrons from being made incident onto the opposing surface 40*a* is formed at a site where the electron multiplying parts 33 and the anode part 34 on the opposing surface 40*a* are loaded.

A further detailed description will be given for an internal structure of the photomultiplier tube 1 by referring to FIG. 3. The electron multiplying parts 33 inside the penetration part 301 are constituted with a plurality of stages of dynodes arrayed so as to be spaced away sequentially from the first end side to the second end side on the opposing surface 40*a* (in a direction indicated by the arrow B which is a direction at which electrons are multiplied). The plurality of stages of dynodes are provided in parallel with a plurality of electron multiplying channels C constituted with the N number of electron multiplying holes installed so as to continue along a direction indicated by the arrow B from a $1^{st}$ stage dynode 33*a* on the first end side to a final stage (the $N^{th}$ stage) dynode 33*b* on the second end side.

Further, the photocathode 41 is installed so as to be spaced away from the $1^{st}$ stage dynode 33 a on the first end side to the first end side on the opposing surface 40*a* behind the focusing electrode 31. The photocathode 41 is formed on the opposing surface 40*a* of the glass substrate 40 as a rectangular transmission-type photocathode. When incident light transmitted from outside through the glass substrate 40, which is the lower frame 4, arrives at the photocathode 41, photoelectrons corresponding to the incident light are emitted, and the photoelectrons are guided into the $1^{st}$ stage dynode 33*a* by the wall-like electrode 32 and the focusing electrodes 31.

Further, the anode part 34 is installed so as to be spaced away from the final stage dynode 33*b* on the second end side to the second end side on the opposing surface 40*a*. The anode part 34 is an electrode for taking outside electrons multiplied inside the electron multiplying channels C of the electron multiplying parts 33 in a direction indicated by the arrow B as an electric signal.

Still further, the wall-like electrode 32 is a rectangular frame-like electrode constituted with a plurality of plate-like parts 32*a* extending substantially in a perpendicular direction only by as thick as the side wall part 302 inside the penetration part 301 so as to run along the inner wall of the side wall part 302 from the opposing surface 40*a* to the upper frame 2 and installed upright on the opposing surface 40*a* in a state that encloses a region of forming the photocathode 41 on the opposing surface 40*a*. An approximately rectangular notched part 35 which has been notched is formed at a site which is the second end side wall part of the wall-like electrode 32 and opposes a region where the electron multiplying channel C is formed at the $1^{st}$ stage dynode 33*a*. Then, a columnar focusing electrode 31 is formed so as to extend substantially in a perpendicular direction from a thin plate-like member 35*a* installed so as to connect both end parts of the notched part 35 on the opposing surface 40*a* to the side of the upper frame 2. It is noted that in the present embodiment, the wall-like electrode 32, the thin plate-like member 35*a* and the focusing electrodes 31 are formed in an integrated manner. However, they may be formed individually.

Figure 4:
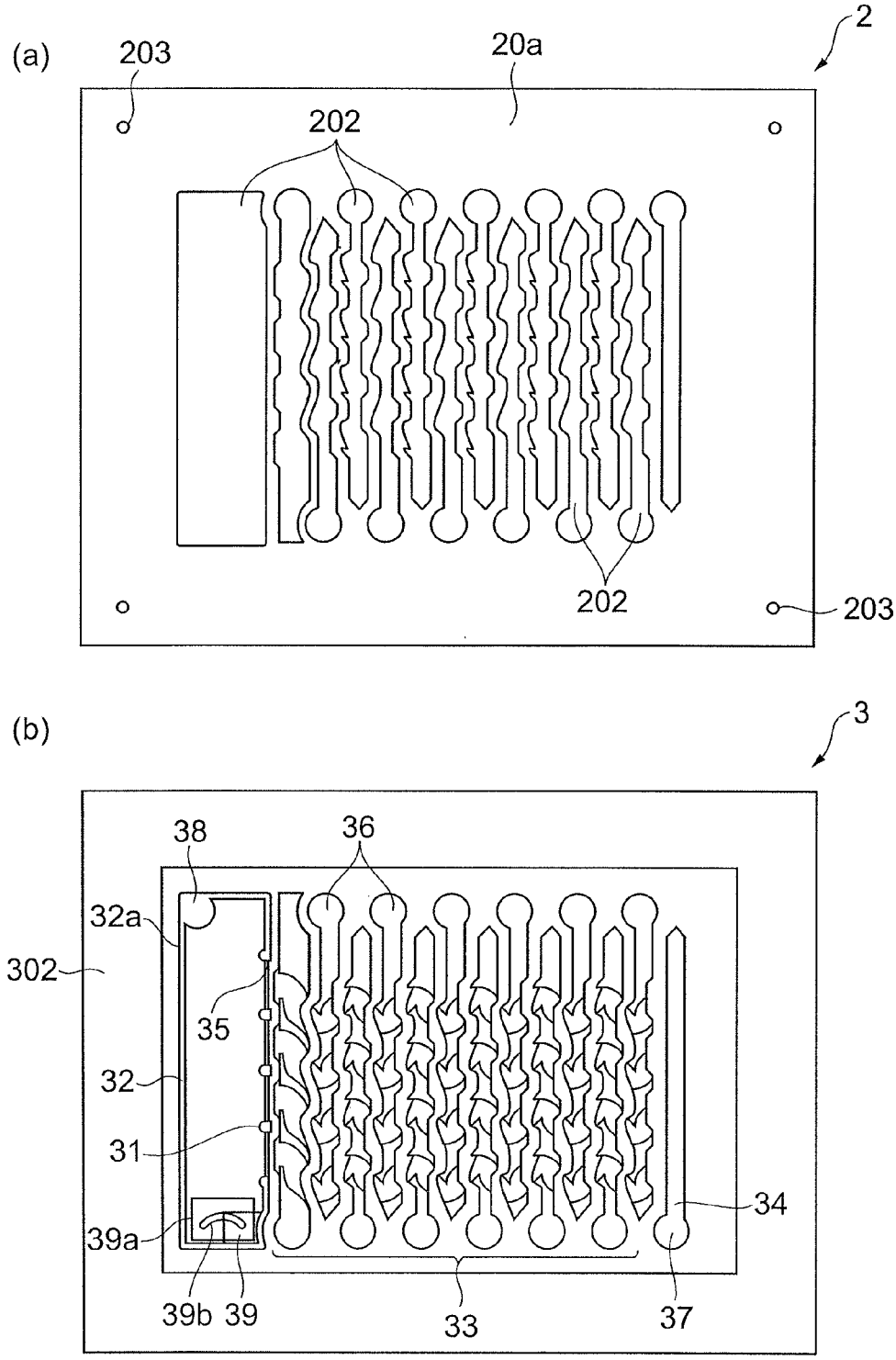
FIG. 4 (*a*) is a bottom view of an upper frame of FIG. 1 when viewed from the back surface side, and FIG. 4 (*b*) is a plan view of the side wall frame of FIG. 1.
Figure 5:
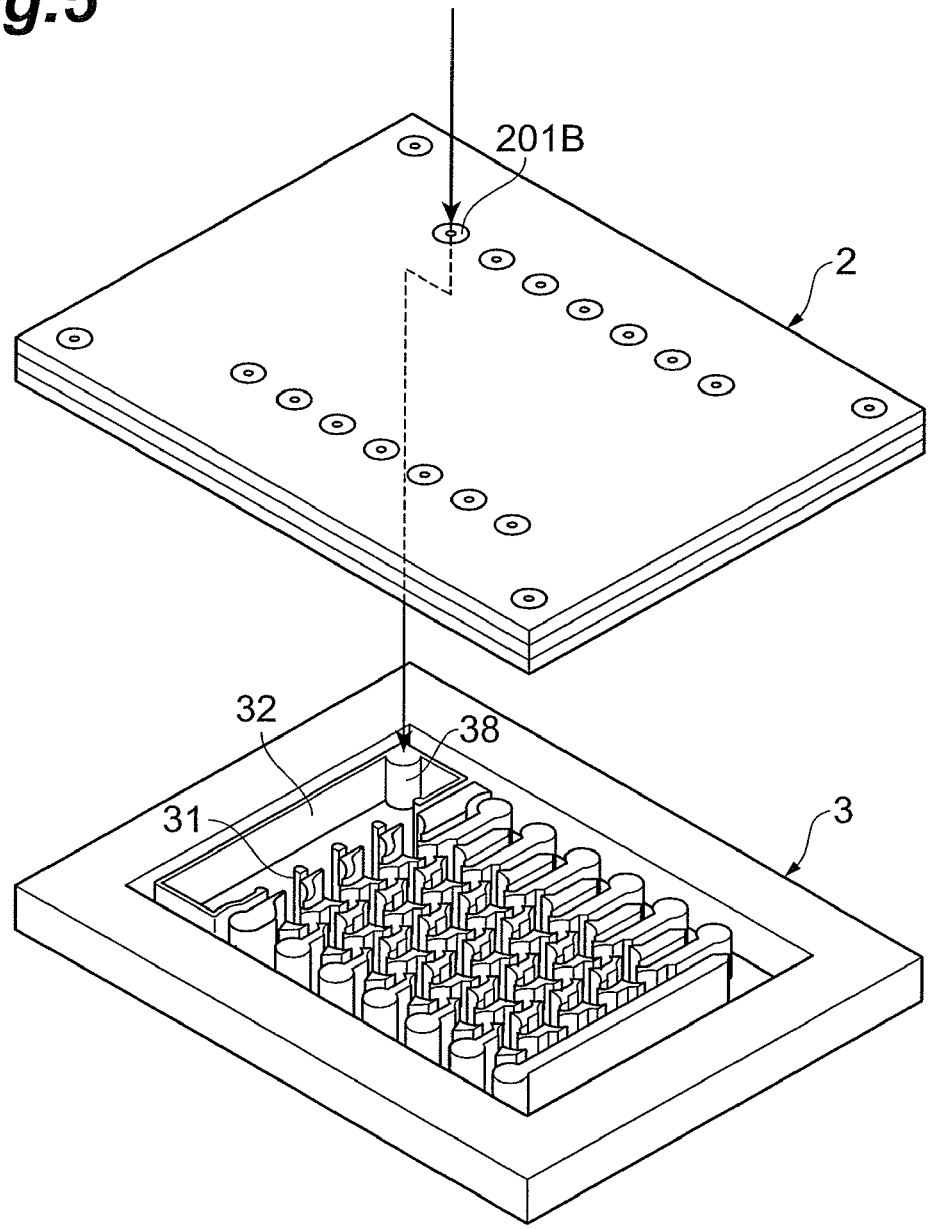
FIG. 5 is a perspective view showing a state which connects the upper frame to the side wall frame as shown in FIG. 4.

Next, a description will be given for a wiring structure of the photomultiplier tube 1 by referring to FIG. 4 and FIG. 5. In FIG. 4, (*a*) is a bottom view when the upper frame 2 is viewed from the side of a back surface 20*a*, and (*b*) is a plan view of the side wall frame 3. FIG. 5 is a perspective view which shows a state connecting the upper frame 2 with the side wall frame 3.

As shown in FIG. 4(*a*), the back surface 20*a* of the upper frame 2 is provided with a plurality of conductive layers 202 electrically connected to the respective conductive terminals 201B, 201C, 201D inside the upper frame 2, and a conductive terminal 203 electrically connected to the conductive terminal 201A inside the upper frame 2. Further, as shown in FIG. 4(*b*), power supplying parts 36, 37 for connecting to the conductive layers 202 are installed upright respectively at the end parts of the electron multiplying parts 33 and the anode part 34, and a power supplying part 38 for connecting to the conductive layers 202 is installed upright at a corner of the wall-like electrode 32. Still further, the focusing electrodes 31 are integrated with wall-like electrode 32 on the lower frame 4 side, together with the thin plate-like member 35*a*, thereby electrically connected to the wall-like electrode 32. In addition, a rectangular flat-plate like connecting part 39 which is thinner than the plate-like part 32*a* of the wall-like electrode 32 is formed in an integrated manner at the wall-like electrode 32 on the opposing surface 40*a* side of the lower frame 4. A conductive layer 39*a* made with a conductive material such as aluminum is formed so as to continue to a part of the opposing surface 40*a* from the upper surface of the connecting part 39. Further, since there is a bump between the connecting part 39 and the opposing surface 40*a*, the continuity is discontinued at the bump portion which may result in the possibility that the conductive layer 39*a* on the connecting part 39 may not be electrically connected to the conductive layer 39*a* on the opposing surface 40*a*. Therefore, the conductive layer 39*a* on the connecting part 39 and the conductive layer 39*a* on the opposing surface 40*a* are wire-bonded by using a wire (a wire member) 39*b* made with a conductive material such as gold (Au), by which the conductive layer 39*a* is made equal in potential as a whole. Then, the photocathode 41 formed on the opposing surface 40*a* enclosed with the wall-like electrode 32 is formed also on the conductive layer 39*a* and the wire 39*b*, by which the wall-like electrode 32 is reliably electrically connected to the photocathode 41. It is noted that when the photocathode is formed also on an inner wall surface of the wall-like electrode 32, that is, on the surface of the plate-like part 32*a* on the side of the photocathode 41, it functions as a reflection-type photocathode as well. In this instance, for example, light which is transmitted without being converted to electrons by the photocathode 41 is subjected to photoelectric conversion, thus making it possible to detect the light more efficiently.

The above constituted upper frame 2 and the side wall frame 3 are joined, by which the conductive terminal 203 is electrically connected to the side wall part 302 of the side wall frame 3. Also, the power supplying part 36 of the electron multiplying part 33, the power supplying part 37 of the anode part 34 and the power supplying part 38 of the wall-like electrode 32 are respectively connected to the corresponding conductive layers 202 independently via conductive members made with gold (Au), etc. The above-described connecting structure makes it possible to electrically connect the side wall part 302, the electron multiplying part 33 and the anode part 34 respectively to the conductive terminals 201A, 201C, 201D. Also, the wall-like electrode 32 is electrically connected to the conductive terminal 201B together with the focusing electrodes 31 and the photocathode 41 (FIG. 5).

According to the photomultiplier tube 1 which has been so far described, incident light is transmitted through the lower frame 4 and made incident onto the photocathode 41, thereby converted to photoelectrons, and the photoelectrons are made incident onto the plurality of stages of electron multiplying parts 33 on the opposing surface 40*a* of the lower frame 4 and multiplied accordingly, and the multiplied electrons are taken out from the anode part 34 as an electric signal. Here, the photocathode 41 is enclosed by the wall-like electrode 32, when viewed from a direction directly opposite to the opposing surface 40*a*, and the notched part 35 is formed on the second end side of the wall-like electrode 32. Therefore, the photoelectrons from the photocathode 41 are prevented from being made incident onto the casing such as the side wall frame 3 and the photoelectrons are guided efficiently into the electron multiplying part 33. As a result, it is possible to enhance the detection sensitivity of incident light onto the photocathode 41.

Figure 10:
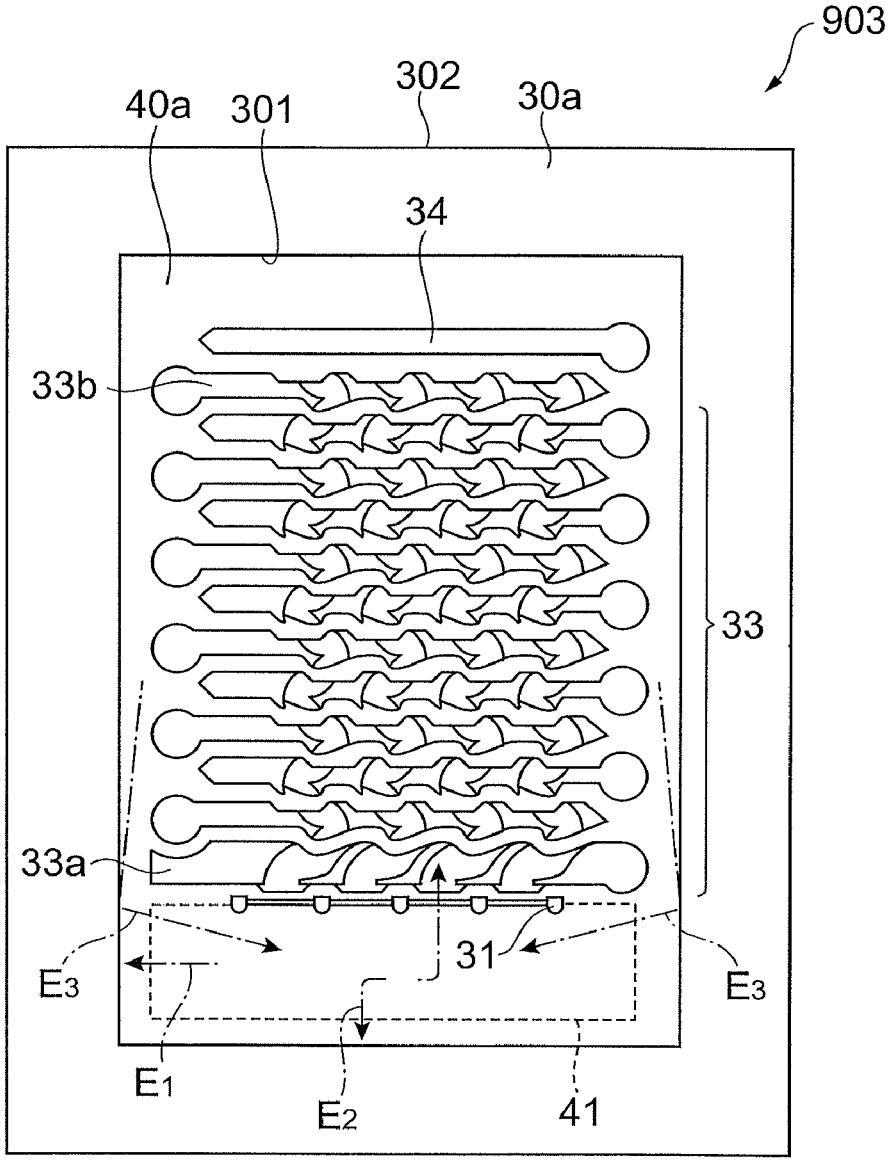
FIG. 10 is a plan view of a side wall frame in which a wall-like electrode is removed from the side wall frame of FIG. 3.

Here, effects of the present embodiment will be described in detail by referring to FIG. 3 and FIG. 10. FIG. 10 is a plan view of the side wall frame 903 in which the wall-like electrode 32 is removed from the side wall frame 3 shown in FIG. 3. Where a side wall frame 903 is used, photoelectrons generated from the photocathode 41 by incident light are mostly made incident onto the $1^{st}$ stage dynode 33*a*, but a portion is guided in directions to the side wall part 302 (directions indicated by the arrows $E_1$, $E_2$ in FIG. 10) and may not contribute to the detection of a signal. This will be made more apparent in a state that the potential of the side wall part 302 is not stable. In addition, of the photoelectrons generated from the photocathode 41, those from a region closer to the side wall part 302 are influenced to a greater extent by the side wall part 302. That is, within the photocathode 41, a region less influenced by the side wall part 302 is a substantially effective region, and therefore, a substantially effective area of the photocathode 41 is decreased. In order to cope with the above problem, there is an idea that a potential equal to that of the photocathode 41 is given to the side wall part 302. However, in this instance, there is a greater difference in potential among the side wall part 302, the electron multiplying part 33 and the anode part 34, which may result in a failure of withstand voltage. This problem is apparent in particular at the anode part 34 and then more apparent at a further subsequent stage of the electron multiplying parts 33. In order to prevent such a withstand voltage failure, it is necessary to secure a sufficient space. As a result, there is an increase in area of a material used in manufacturing one chip, which may result in an increase in cost. Further, there is a case that light may be emitted at the second end side inside the penetration part 301, etc., by collision of multiplied secondary electrons against an insulating body. When the light advances as indicated by the arrow $E_3$ and arrives at the photocathode 41, photoelectrons which are not related to incident light are emitted and there is a concern that noise will be generated in a detection signal to decrease an SN ratio.

On the other hand, in the present embodiment, photoelectrons generated from the photocathode 41 can be efficiently made incident onto the $1^{st}$ stage dynode 33*a* (a direction indicated by the arrow $E_4$ in FIG. 3), irrespective of a potential of the side wall part 302, due to the presence of the wall-like electrode 32 which is set to be stable in potential. Further, even when the light generated on the second end side, etc., inside the penetration part 301 advances in a direction toward the photocathode 41 (a direction indicated by the arrow $E_5$ in FIG. 3), the light can be blocked by the wall-like electrode 32 and prevented from being made incident onto the photocathode 41. Thereby, it is possible to maintain the detection sensitivity when a potential of the side wall part 302 is set to be free and also enhance an SN ratio by improving noise characteristics. For example, the side wall part 302 is set to be a ground potential as a desired potential, thus making it possible to enhance electric noise characteristics of the photomultiplier tube 1. In particular, a noise-reduction effect can be maximized by being set to the ground potential and a possible risk of electrification of humans can be also decreased. Further, since a region enclosed by the wall-like electrode 32 is a substantially effective region of the photocathode, an appropriate light incident region can be easily specified when the photomultiplier tube 1 is viewed from outside.

Further, the photocathode 41 is electrically connected to the wall-like electrode 32 and set to be equal in potential. Therefore, there is formed an electric field where photoelectrons from the photocathode 41 are favorably guided into the electron multiplying part 33 without being made incident onto the wall-like electrode 32, by which the detection sensitivity is further enhanced.

Still further, the notched part 35 of the wall-like electrode 32 is formed at a site opposing a region of the electron multiplying channels C of the electron multiplying parts 33, by which photoelectrons guided into the electron multiplying parts 33 can be efficiently multiplied to further enhance the detection sensitivity of incident light.

Figure 6:
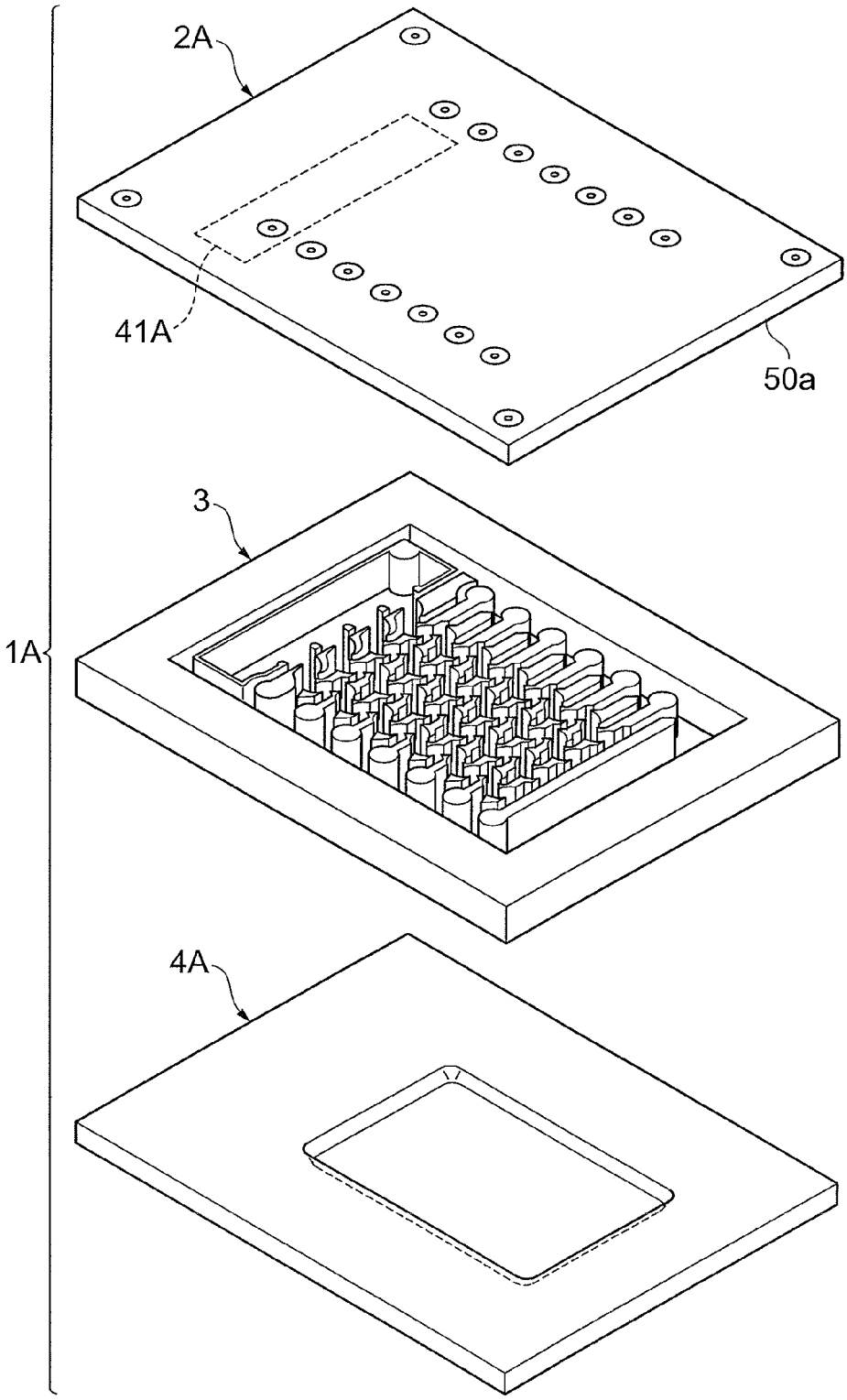
FIG. 6 is an exploded perspective view which shows a photomultiplier tube related to a modified example of the present invention.

It is noted that the present invention shall not be limited to the embodiments so far described. For example, as shown in a photomultiplier tube 1A in FIG. 6, which is a modified example of the present invention, a photocathode 41A may be installed on the back surface (an opposing surface 50*a*) side of an upper frame 2A. In this instance, as the upper frame 2A, that in which power supplying terminals are buried into a translucent insulating substrate such as a glass substrate can be used. As a lower frame 4A, various insulating substrates can be used other than a glass substrate. Then, a wall-like electrode 32 is arranged so as to enclose the photocathode 41A when viewed from a direction directly opposite to the opposing surface 50*a* of the upper frame 2A (a direction approximately perpendicular to the opposing surface 50*a*).

Figure 7:
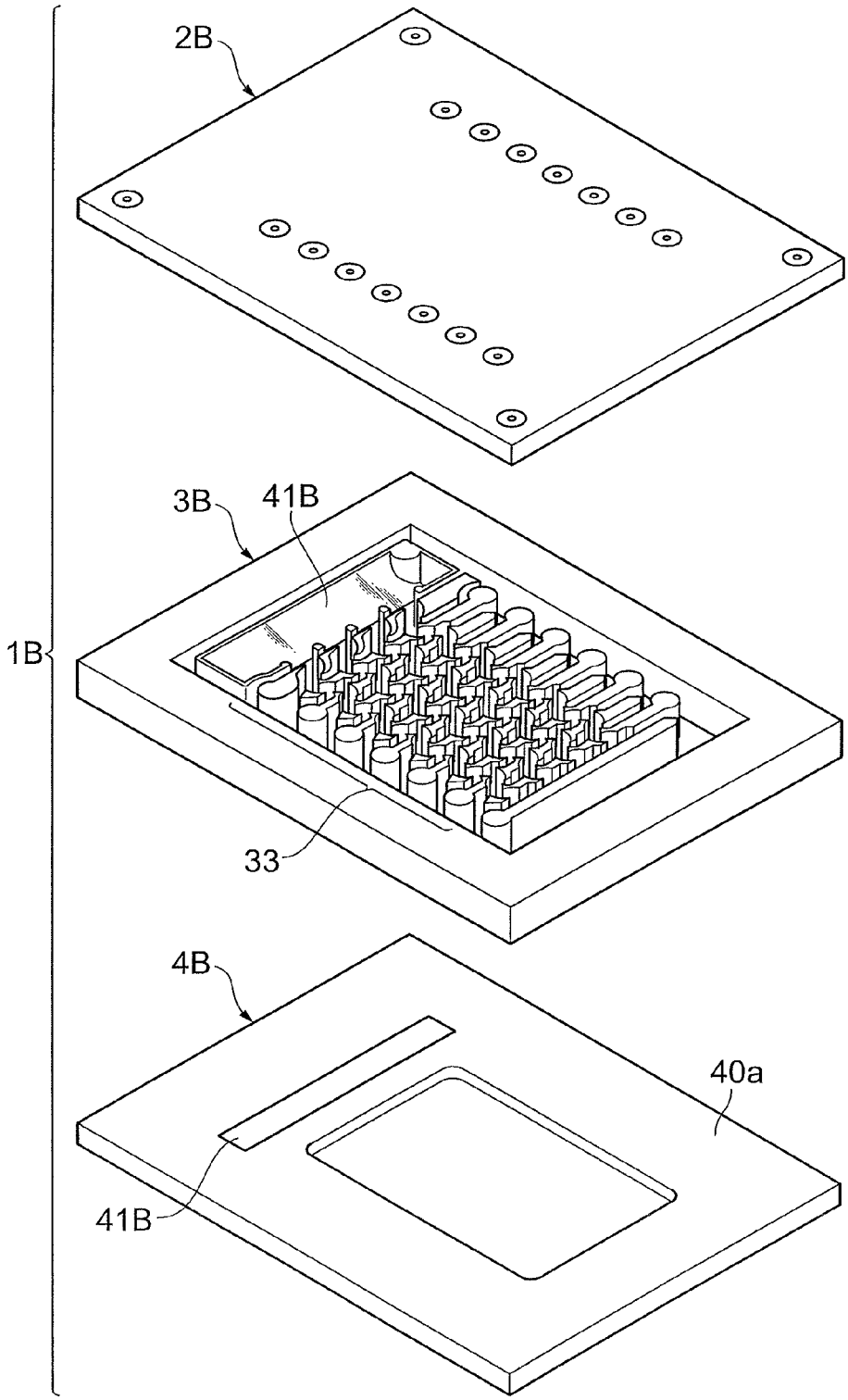
FIG. 7 is an exploded perspective view of a photomultiplier tube related to another modified example of the present invention.

Further, as shown in a photomultiplier tube 1B in FIG. 7, which is a modified example of the present invention, the photocathode may be a reflection-type photocathode. For example, a translucent insulating substrate is used as an upper frame 2B and an inclined surface which is inclined to the second end side with respect to an opposing surface 40*a* is formed inside a wall-like electrode 32B of a side wall frame 3B. A photocathode 41B is formed from the inclined surface to the opposing surface 40*a*. A configuration of the inclined surface may include a flat surface or a curved surface as long as it is such a configuration that photoelectrons generated from the photocathode 41B by incident light which has been transmitted through the upper frame 2B move toward electron multiplying parts 33.

Figure 8:
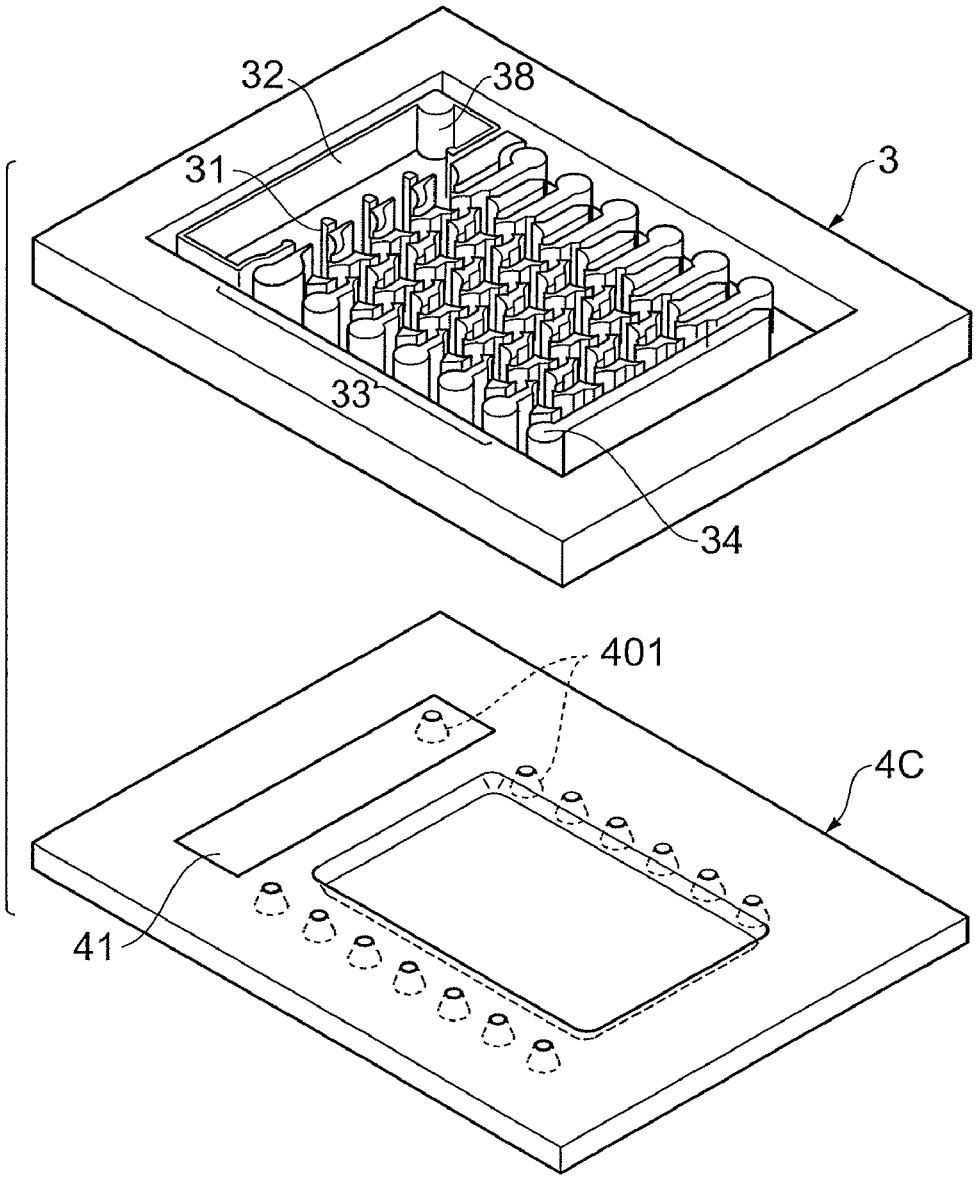
FIG. 8 is an exploded perspective view of a photomultiplier tube related to still another modified example of the present invention.

Further, various modified modes can be adopted in a wiring structure of the present embodiment. For example, as shown in FIG. 8, such a structure may be provided that conductive terminals 401 are formed so as to penetrate through the lower frame 4C, and power is supplied via the conductive terminals 401 to the photocathode 41, the wall-like electrode 32, the focusing electrodes 31, the electron multiplying parts 33 and the anode part 34. This structure makes it possible to supply power independently to the conductive layers 202 (FIG. 4(*a*)) formed on the upper frame 2 and each of the electrodes.

Figure 9:
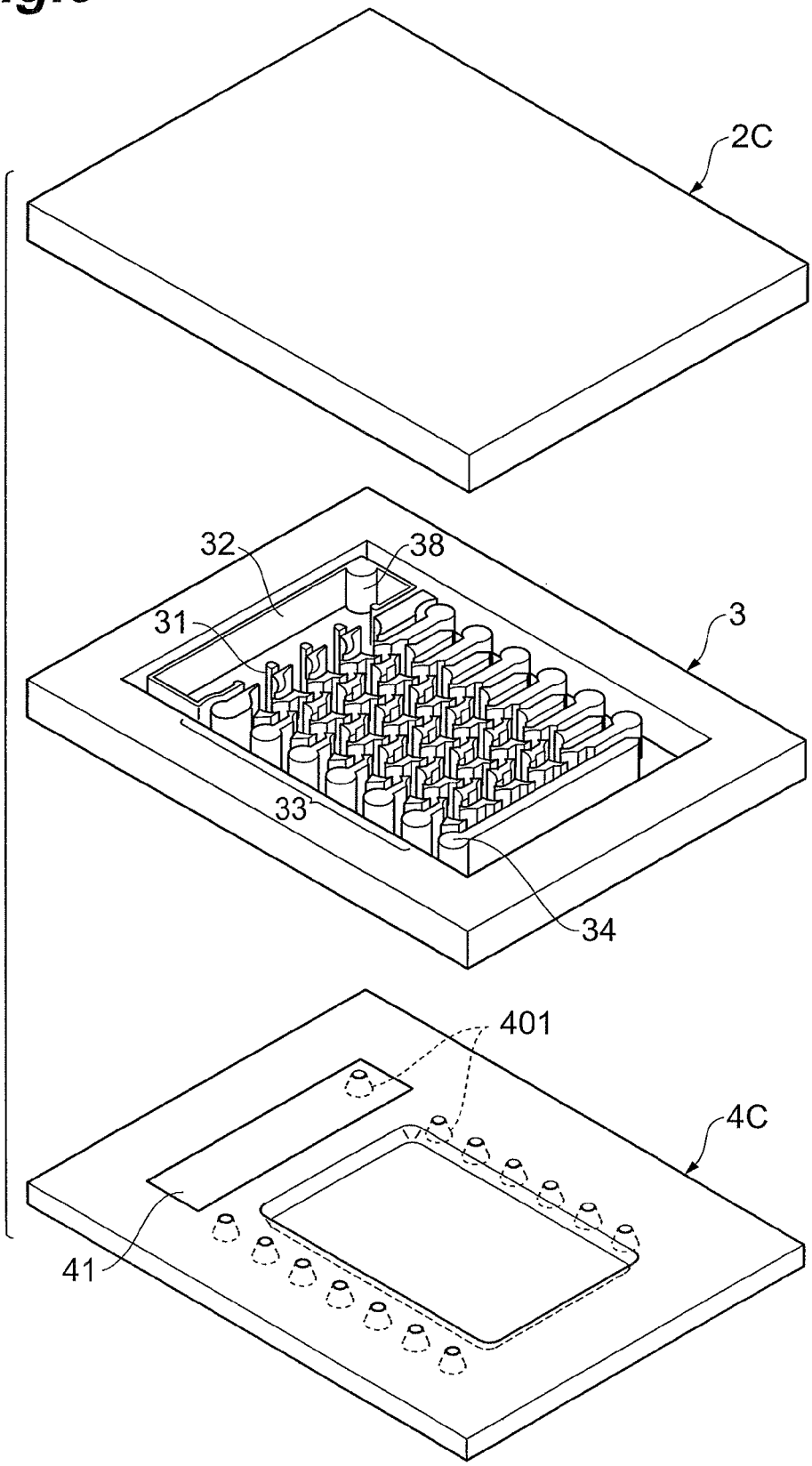
FIG. 9 is an exploded perspective view of a photomultiplier tube related to a further modified example of the present invention.

Still further, as shown in FIG. 9, the lower frame 4C having the conductive terminals 401 may be combined with the upper frame 2C from which the conductive terminals 201A to 201D are removed. In this instance, an insulating substrate having a plurality of conductive layers 202 on the back surface side is used as the upper frame 2C. The wiring structure described by referring to FIG. 4 is used in the above combination, thus making it possible to supply power from the conductive terminals 401 of the lower frame 4C to the conductive layers 202 of the upper frame 2C via the wall-like electrode 32, the electron multiplying parts 33 and the anode part 34.

In addition, in any of the embodiments and the modified examples, it is not always necessary that the wall-like electrode 32 encloses the photocathode 41 as a whole, but may be arranged so as not to enclose an edge part if it encloses a substantially effective region that can guide emitted photoelectrons into the electron multiplying parts 33.

What is claimed is:

1. A photomultiplier tube comprising:

a first substrate and a second substrate which are arranged so as to oppose each other, with the respective opposing surfaces made with an insulating material;

a side wall part which constitutes a casing together with the first and the second substrates;

a plurality of stages of electron multiplying parts which are arrayed so as to be spaced away sequentially from a first end side to a second end side on the opposing surface of the first substrate;

a photocathode which is installed on the first end side so as to be spaced away from the electron multiplying parts, converting incident light from outside to photoelectrons to emit the photoelectrons;

an anode part which is installed on the second end side so as to be spaced away from the electron multiplying parts to take out electrons multiplied by the electron multiplying parts as a signal; and a wall-like electrode which is arranged so as to enclose the photocathode when viewed from a direction directly opposite to the opposing surface and having a notched part at a site opposing the electron multiplying parts on the second end side, the wall-like electrode electrically and structurally separated from the plurality of stages of the electron multiplying parts.

2. The photomultiplier tube according to claim 1, wherein the photocathode is electrically connected to the wall-like electrode.

3. The photomultiplier tube according to claim 1, wherein the notched part is formed at a site corresponding to a region of electron multiplying channels of the electron multiplying parts.

4. The photomultiplier tube according to claim 1, wherein focusing electrodes for guiding the photoelectrons emitted from the photocathode into the electron multiplying parts are installed inside the notched part.

5. The photomultiplier tube according to claim 1, wherein a connecting part for electrically connecting to the photocathode is installed at the wall-like electrode.

6. The photomultiplier tube according to claim 5 which is further provided with conductive layers installed on the upper surface of the connecting part and at a part of at least one of the opposing surfaces of the first and the second substrate, wherein the connecting part is formed in a flat-plate shape which is thinner than a plate-like part that is a portion of the wall-like electrode enclosing the photocathode, and the photocathode is installed on at least one of the opposing surfaces of the first and the second substrate, and on the conductive layers.

7. The photomultiplier tube according to claim 6, wherein the conductive layer on the upper surface of the connecting part is electrically connected to the conductive layer installed at a part of at least one of the opposing surfaces of the first and the second substrate by using a wire member made with a conductive material.

8. A photomultiplier tube comprising a first substrate and a second substrate which are arranged so as to oppose each other, with the respective opposing surfaces made with an insulating material;

a side wall which constitutes a casing together with the first and the second substrates;

a plurality of stages of electron multiplying parts which are arrayed so as to be spaced away sequentially from a first end side to a second end side on the opposing surface of the first substrate;

a photocathode which is installed on the first end side so as to be spaced away from the electron multiplying parts, converting incident light from outside to photoelectrons to emit the photoelectrons;

an anode part which is installed on the second end side so as to be spaced away from the electron multiplying parts to take out electrons multiplied by the electron multiplying parts as a signal; and a wall-like electrode enclosing the photocathode when viewed from a direction directly opposite to the opposing surface, wherein the wall-like electrode includes, a first plate-like part and a second plate-like part which are arranged between the photocathode and the side wall and extending from the first end side to the second end side, a third plate-like part which is arranged between the photocathode and the side wall and connected to the first end side of the first plate-like part and the second plate-like part, and a fourth plate-like part which is arranged between the photocathode and the electron multiplying parts and connected to the second end side of the first plate-like part, the second plate-like part and has a notched part at a site opposing the electron multiplying parts on the second end side.

9. The photomultiplier tube according to claim 8, wherein the first and second plate-like parts are thinner than one stage of the electron multiplying parts when viewed from a direction directly opposite to the opposing surface.

10. The photomultiplier tube according to claim 8, further comprising:

a thin plate-like member which connects both end parts of the notched part, and a focusing electrode is formed on the thin plate-like member.

11. A photomultiplier tube comprising:

a first substrate and a second substrate which are arranged so as to oppose each other, with the respective opposing surfaces made with an insulating material;

a side wall part which constitutes a casing together with the first and the second substrates;

a plurality of stages of electron multiplying parts which are arrayed so as to be spaced away sequentially from a first end side to a second end side on the opposing surface of the first substrate;

a photocathode which is installed on the first end side so as to be spaced away from the electron multiplying parts, converting incident light from outside to photoelectrons to emit the photoelectrons;

an anode part which is installed on the second end side so as to be spaced away from the electron multiplying parts to take out electrons multiplied by the electron multiplying parts as a signal; and a wall-like electrode enclosing the photocathode when viewed from a direction directly opposite to the opposing surface and having a notched part at a site opposing the electron multiplying parts on the second end side, the wall-like electrode having a connecting part to electrically connect with the photocathode, wherein conductive layers are installed on the upper surface of the connecting part and at a part of at least one of the opposing surfaces of the first and the second substrate, the connecting part is formed in a flat-plate shape which is thinner than a plate-like part that is a portion of the wall-like electrode enclosing the photocathode, and the photocathode is installed on at least one of the opposing surfaces of the first and the second substrate and on the conductive layers, and wherein the conductive layer on the upper surface of the connecting part is electrically connected to the conductive layer installed on at least one of the opposing surfaces of the first and the second substrate, by using a wire member made with a conductive material.

* * * * *